US007421817B2

(12) United States Patent
Larsson

(10) Patent No.: US 7,421,817 B2
(45) Date of Patent: Sep. 9, 2008

(54) GUN ACCESSORY MOUNTING DEVICE

(75) Inventor: Sven-Erik Larsson, Akarp (SE)

(73) Assignee: Surefire, LLC, Fountain Valley, CA (US)

( * ) Notice: Subject to any disclaimer, the term of this patent is extended or adjusted under 35 U.S.C. 154(b) by 438 days.

(21) Appl. No.: 10/505,985

(22) PCT Filed: Feb. 25, 2003

(86) PCT No.: PCT/SE03/00298

§ 371 (c)(1),
(2), (4) Date: Apr. 8, 2005

(87) PCT Pub. No.: WO03/089868

PCT Pub. Date: Oct. 30, 2003

(65) Prior Publication Data

US 2005/0204603 A1 Sep. 22, 2005

(30) Foreign Application Priority Data

Feb. 25, 2002 (SE) ..... 0200552

(51) Int. Cl.
*F41G 1/32* (2006.01)
*F41G 1/00* (2006.01)

(52) U.S. Cl. ..... 42/127; 42/146

(58) Field of Classification Search ..... 42/115, 42/135, 142, 146, 148, 127
See application file for complete search history.

(56) References Cited

U.S. PATENT DOCUMENTS

| | | | | |
|---|---|---|---|---|
| 2,942,346 | A * | 6/1960 | Staubach | 42/127 |
| 3,781,101 | A * | 12/1973 | Kaneko et al. | 352/221 |
| 4,244,131 | A * | 1/1981 | Kaelin | 42/115 |
| 4,291,479 | A * | 9/1981 | Lough | 42/115 |
| 4,494,328 | A * | 1/1985 | Stevens | 42/115 |
| 5,304,757 | A * | 4/1994 | Hensel | 200/82 R |
| 5,560,703 | A | 10/1996 | Capps | 362/110 |
| 5,621,999 | A | 4/1997 | Moore | 42/117 |
| 6,267,279 | B1 * | 7/2001 | Matthews | 224/243 |
| 6,571,503 | B2 * | 6/2003 | Thorpe | 42/114 |
| 7,076,908 | B2 * | 7/2006 | Kim | 42/146 |
| 7,134,234 | B1 * | 11/2006 | Makarounis | 42/146 |
| 2003/0029072 | A1 * | 2/2003 | Danielson et al. | 42/114 |
| 2005/0115142 | A1 * | 6/2005 | Kim | 42/146 |
| 2005/0246937 | A1 * | 11/2005 | Kim | 42/146 |
| 2005/0257415 | A1 * | 11/2005 | Solinsky et al. | 42/146 |
| 2005/0279004 | A1 * | 12/2005 | Woodmansee et al. | 42/146 |

FOREIGN PATENT DOCUMENTS

| | | |
|---|---|---|
| BE | 1010257 | 4/1998 |
| WO | WO 00/77470 | 12/2000 |

* cited by examiner

*Primary Examiner*—Michael J. Carone
*Assistant Examiner*—Michael D David
(74) *Attorney, Agent, or Firm*—MacPherson Kwok Chen & Heid LLP

(57) ABSTRACT

Mounting device for an accessory (11), such as a lamp (27) for guns. Said accessory (11) is connected to an adapter (10) which is provided with a gripping means (17; 22). Said gripping means (17, 22) comprises a spring biased clamping mechanism (15; 18; 20; 22; 24) and a counter stay (17) cooperating with said clamping mechanism.

13 Claims, 4 Drawing Sheets

GUN ACCESSORY MOUNTING DEVICE

FIELD OF PRESENT INVENTION

The invention relates to a gun accessory mounting device. The term accessory stands mainly for components and devices that will not influence directly on the function of the gun.

PRIOR ART

Many guns allow use together with different accessories. In some circumstances it is desirable to mount the accessory on the gun. This may for instance be a spare magazine, extra sights or other similar accessories. When mounting sights on a gun often an adapter is mounted stationary on the gun in advance, so as to allow the sight to be mounted in an exact position to achieve the desired precision. The mounting of the sight can also be carried out fast and simple.

A drawback with stationary mounted adapters is that they take up space and may influence on the handling of the gun and other functions of the gun. When used on for instance hand guns that are carried in a holster the adaptation of the holster to the gun may render such adapters impossible.

SUMMARY OF THE PRESENT INVENTION

An object of the present invention is to avoid the above described problems and to provide a mounting device adapted to a certain accessory, where the mounting device does not influence the function of the gun when the accessory is not used. This object is achieved by providing the accessory with an adapter. The adapter in turn is provided with a gripping means that may comprise a spring biased clamping mechanism and a counter stay cooperating with the clamping mechanism. The adapter can be mounted on the gun without any modification or extra equipment required of the gun.

The counter stay can be adapted to a trigger guard of the gun, so as to engage an interior end section of the trigger guard connecting to the barrel of the gun. When using the adapter in accordance with the invention the counter stay is disposed interior in the trigger guard and a clamping arm is tensioned. When tensioning the clamping arm a spring biased pressure plate is pressed against the exterior of said section of the trigger guard. The clamping arm moves to a locked position and holds in this position the accessory firmly in line with the gun. The accessory can comprise a lamp, which in this position will have the same direction as the barrel of the gun. In this application the clamping arm preferably is firmly or rigidly connected to the lamp to make a rotation of the lamp directly providing the required rotation of the clamping arm.

In one embodiment the accessory comprises an elongated lamp which is rigidly connected to the adapter. The adapter comprises a pivotable rod, which in a first end is pivotably connected to a clamping arm and in a second end is pivotaly connected to a lever. When turning the clamping arm the rod will achieve a displacement of the lever and a spring set connected to the lever towards the pressure plate.

When turning the clamping arm the rod will move in a stroke past a dead center, in which there is a maximum spring biasing, to a resting position, in which the rod is locked to prevent a returning movement. In one embodiment a rounded-out end of the rod runs against a pin extending perpendicular to the clamping arm. In the locked position the rod is pressed against the pin by a spring. When the rod is released the clamping arm has to move the rod against the force of the spring past the pin.

In one embodiment the adapter is provided with a locking device locking the adapter against an unintentional release. Only after manually releasing the locking device the clamping arm can be released so as to release the pressure from the pressure plate and to allow the removal of the accessory. In an embodiment comprising a lamp or other electrical equipment the adapter can be provided with a switch for turning the equipment on and off. The pressure plate and the counter stay together form a gripping means which can be snapped on a section of the gun and be locked in that position.

The switch can comprise a magnetic element and a switching element controlled by said magnetic element. The switching element will close and open a circuit in dependence of the relative position between the magnetic element and the switching element.

BRIEF DESCRIPTION OF THE DRAWINGS

The invention will now be described by different embodiments with reference to the drawings, wherein.

DETAILED DESCRIPTION

Figure 1:
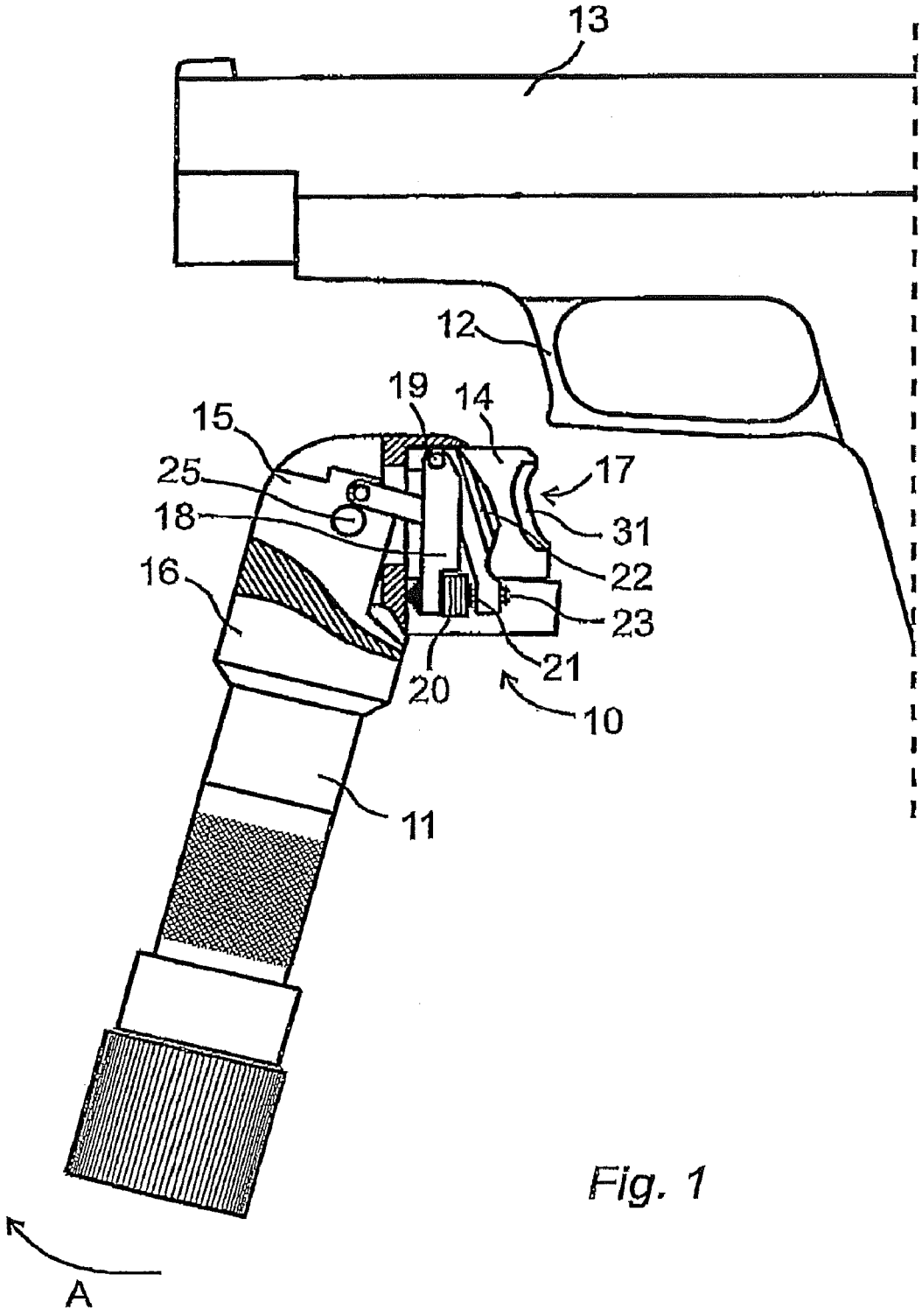
FIG. 1 is a schematic side elevational view of a section of a gun and an embodiment of a mounting device with an adapter in accordance with the invention mounted on an accessory.

In the embodiment of an adapter in accordance with the invention as shown in FIG. 1 the adapter is rigidly connected to an accessory 11 in the form of a lamp. The accessory in this embodiment is intended to be mounted on a trigger guard 12 of a gun 13, the gun being shown only partly in FIG. 1. Other types of accessories, such as sights and communication devices can within the scope of the invention be mounted correspondingly on other sections of the gun, such as the barrel or another stationary part of the gun.

The adapter 10 comprises a base plate 14 and a clamping arm pivotally mounted in relation to the base plate 14. In the embodiment of the adapter shown in FIG. 1 the clamping arm is connected to a rear section of the lamp 11. The rear section of the lamp normally comprises a cap for battery and a switch. In the embodiment shown the cap is replaced by a cap 16 associated to the adapter, the cap 16 forming a part of the clamping of arm 15. By connecting the cap 16 to the lamp 11 a rigid connection is provided between the clamping arm and the lamp. Thus, a pivoting movement of the lamp will provide a corresponding pivoting movement of the clamping arm.

The base plate 14 is in a first end pivotally connected to the clamping arm and in an opposite end provided with a counter stay 17 formed as a rail extending perpendicular from the base plate 14. The rail comprises a shackle handle 31 and is adapted for engaging an inside of a front section of the trigger guard 12. Preferably the rail is also somewhat curved so as to partly enclose the trigger guard.

On the base plate 14 there is provided also a lever 18, which in a first end is pivoted around a cylindrical first pin 19 and in an opposite second end supports a spring set 20 on a bar 21 that is threaded in one end. In the embodiment shown the spring set 20 comprises a plurality of circular cup springs. The bar 21 extends substantially perpendicular from the lever and extends through a pressure plate 22 pivoted around said first pin 19. The components provided on the base plate comprise together with the clamping arm and the rod 24 a clamping mechanism. The pressure plate 22 can be curved similar to the counter stay 17 so as to enclose at least partially the trigger guard. As a result forces arising on the trigger guard are distributed better over a bigger part of the trigger guard and rotation and displacement of the adapter is prevented.

A threaded section of the bar 21 is received in a correspondingly threaded through hole of the pressure plate 22. A groove 23 in the end of the bar 21 allows an adjustment of the spring force of the spring set 20. By turning the clamping arm 15 the rod can turn the lever against the pressure plate 22. During this movement of the rod the spring set is pressed against the pressure plate 22 which in turn is pressed in the direction of the counter stay 17.

The movement of the lever 18 can be achieved as a result of being articulately connected to a first end of a rod 24. A second end of the rod is pivotally connected to the clamping arm 15. When the clamping arm 15 is pivoted the rod 24 will perform an essentially linear movement in the direction of the pressure plate 22. This function is further described with reference to FIGS. 2-4. In use the base plate is disposed behind the trigger guard whereas the trigger guard is received in an empty space between the counter stay 17 and the pressure plate 22. Then the lamp is pivoted upwards in the direction of an arrow A. The rotation of the lamp will result in a corresponding rotation of the clamping arm 15. The clamping arm 15 is pivoted around a second cylindrical pin 25.

Different types of accessories can be used in accordance with the invention. Furthermore, the accessory can be mounted on other sections of the gun than the trigger guard. For guns of the type shown in FIG. 1 the adapter can be designed to be mounted on a stationary section below the barrel of the gun. The gripping means extends over the section of the gun and is mounted by moving opposite parts of the gripping means in the direction towards each other and is locked by a spring biasing function.

Figure 2:
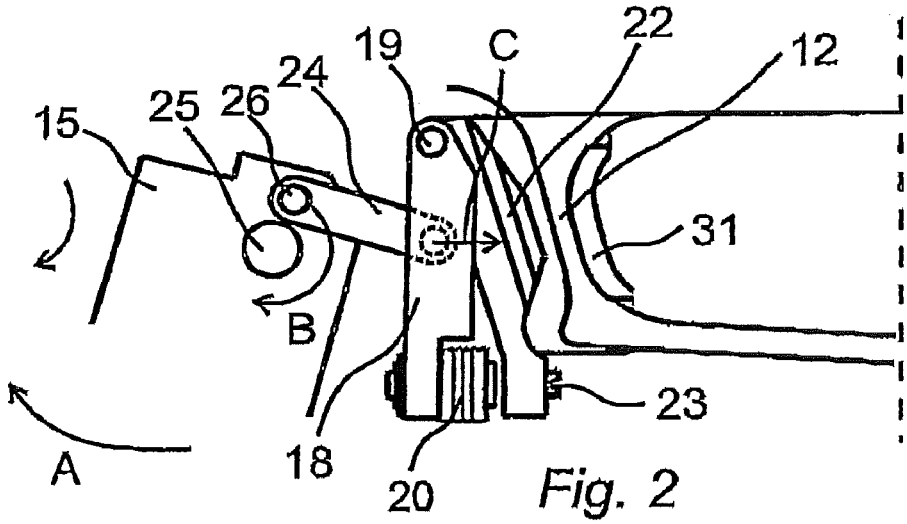
FIG. 2 is a schematic detailed view of the adapter and a section of the gun in FIG. 1 with the adapter in a mounting position, FIG. 3. is a schematic detailed view of the adapter and a section of the gun in FIG. 1 with the adapter set into a locking position.
Figure 3:
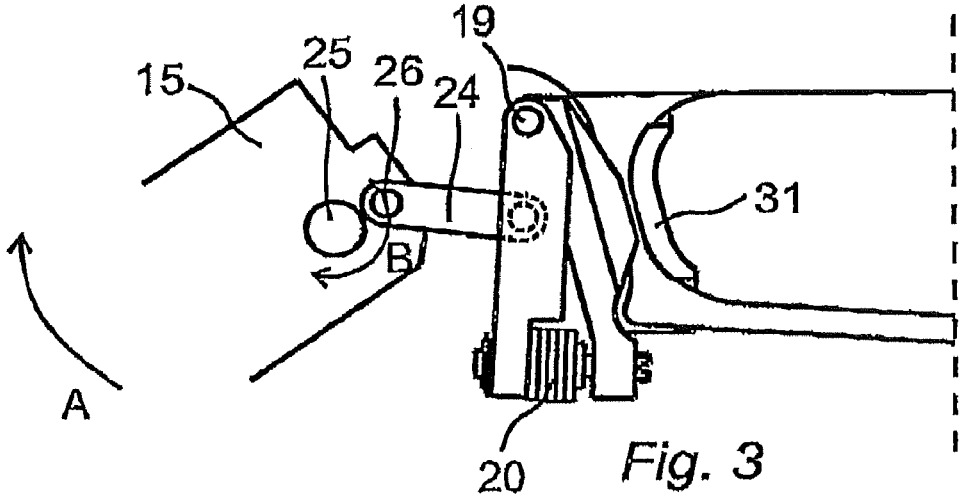
Figure 4:
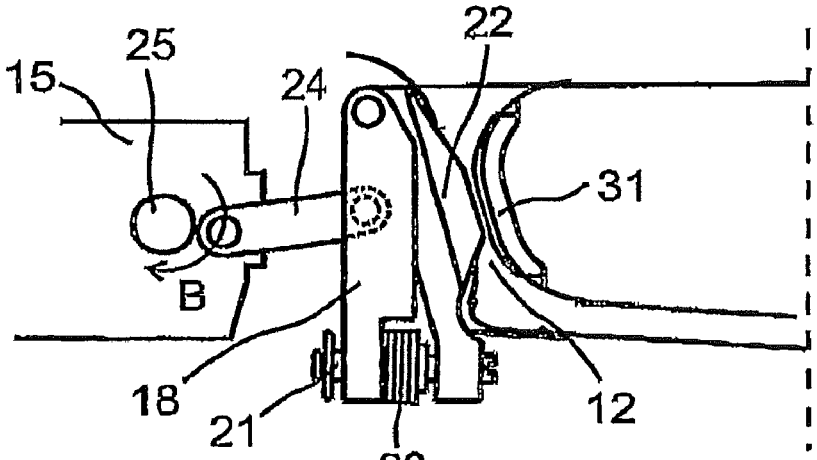
FIG. 4 is a schematic detailed view of the adapter and a section of the gun in FIG. 1 with the adapter set into a locked position.

FIG. 2 to FIG. 4, along with FIG. 1, show an example of the function of the rod 24 and the lever 18. In FIG. 2 the clamping mechanism is released and the adapter can be disposed with a trigger guard 12 received between the counter stay 17 and the pressure plate 22. The distance between the pressure plate 22 and the counter stay 17 can be adjusted by means of a screw driver or similar tool, set in the groove 23 and then rotated. When rotating the bar 21 the pressure plate will be displaced either against or from the counter stay. The adjustment should be done in such a way that the adapter easily can be located in the correct position but also in a way to make the pressure plate engaging the trigger guard after only a short rotating movement of the clamping arm 15. In this position the spring set 20 does not act on the pressure plate.

The rod 24 is pivoted in both ends. In a first end the rod 24 is pivoted centrally in the lever 18 and in the second end the rod 24 is pivoted in a third cylindrical pin 26. When rotating the clamping arm 15 the rod 24 will move along the curve B in FIG. 2. During this movement the rod will also perform an essentially linear movement to the right in FIG. 2, which is indicated at the arrow C, also carrying the lever 18. The movement in the direction of the arrow C is governed by a horizontal groove in the base plate. The first cylindrical pin 19 is not fixed in the base plate 14 but can be moved to some extent. The flexibility is required to allow the pressure plate 22 to adapt to Inclination and position of the section of the trigger guard which the pressure plate will engage.

In the position shown in FIG. 3 the clamping arm 15 has been rotated in the direction of the arrow A and thus also rotated rod 24. At the same time the end of the rod that is pivoted in the lever has been moved to the right. The lever 18 has also been rotated to some extent so as to be adapted to the inclination of the trigger guard. The lever 18 has moved the spring set 20 towards the pressure plate 22, but without compressing the spring set.

In the embodiment shown in FIG. 4 the clamping arm 15 has been rotated further in the direction of the arrow A. The rod 24 has been rotated past a dead center and has been displaced somewhat to the left in FIG. 4. The rod forms together with the clamping arm a link, which in FIG. 4 has reached a stable locked position. In this position the rod also has moved the lever 18 so far against the pressure plate that the spring set has been compressed. As a result a spring force against the pressure plate has been built up. The spring force will insure that the adapter is hold firmly against the section of the gun located between pressure plate 22 and the counter stay 17, which in the shown embodiment is the trigger guard 12. The compression of the spring set also results in a section of the bar 21 being visible outside the lever 18.

Figure 5:
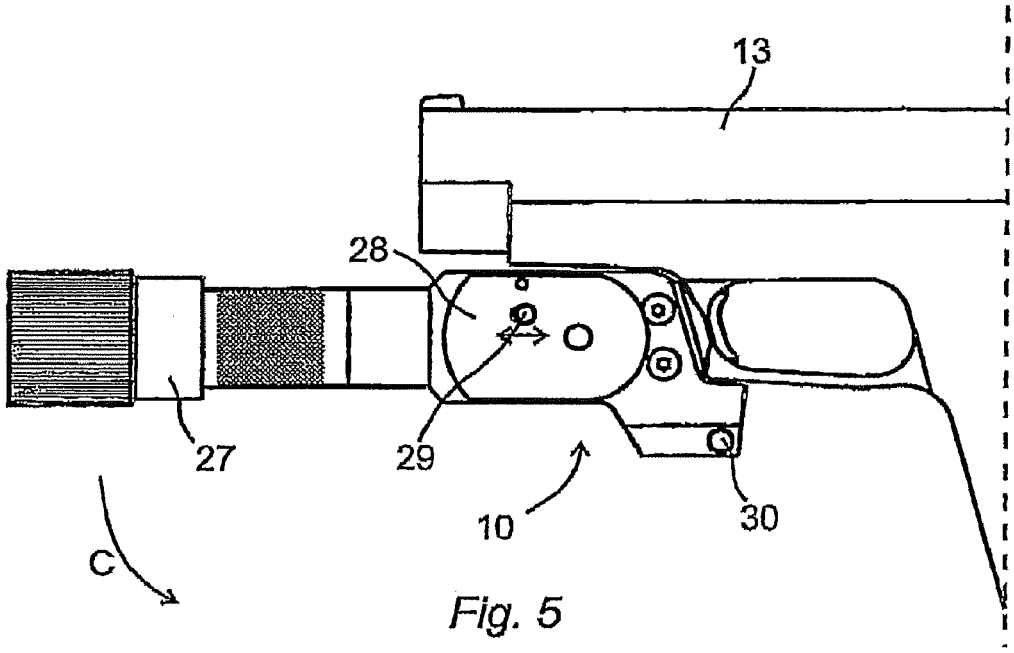
FIG. 5 is a schematic side elevational view of a section of a gun with an adapter and an accessory mounted thereon.

FIG. 5 shows an adapter 10 with a lamp 27 in a functional position on a gun 13. Some sections of the clamping mechanism is covered under a side panel 28. The clamping mechanism can be locked in the shown position by means of a lock 29. The lock 29 snaps into a locked position automatically when the lamp 27 is rotated upwards and has to be actuated manually to allow the lamp 27 to be rotated downwards in the direction of the arrow C. The lock will ensure that the lamp is not lowered and the adapter released due to strong movement, such as the recoil when the gun is fired.

In the embodiment in accordance with the invention shown in FIG. 5 the accessory is a lamp 27. The lamp is a conventional lamp with a switch provided in a rear section. In this application the complete rear section is replaced by a section of the adapter. Electrical wires covered behind the side panel 28 are connected to accumulators in the lamp, or to another type of power source. The wires extend to a switch mounted on the adapter, the switch being operated by a operating means 30, so as to allow a user to switch on and off the lamp with a finger.

Figure 6:
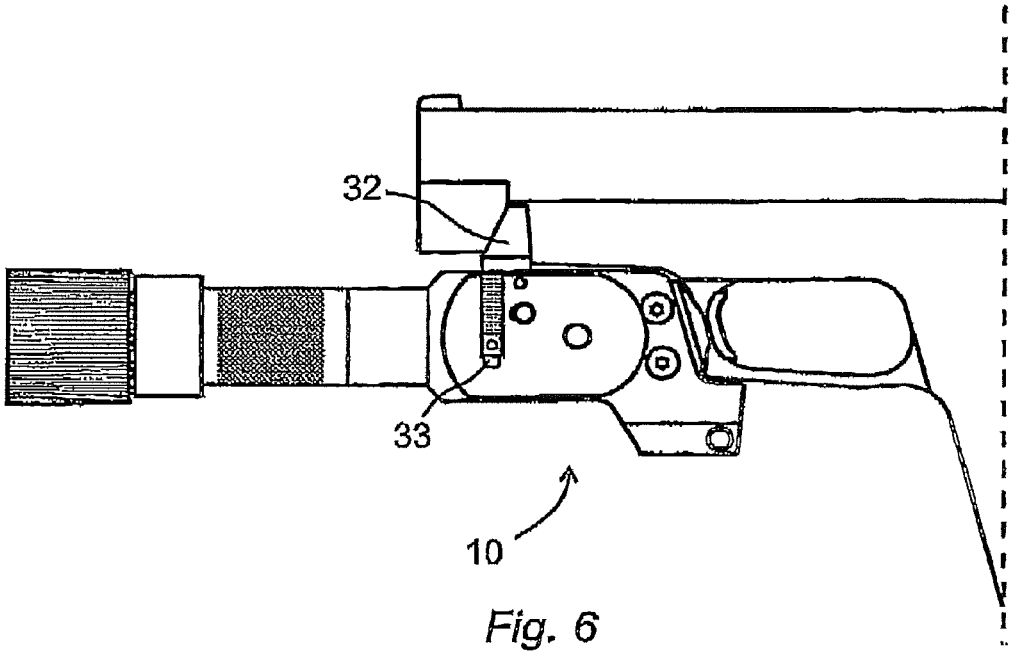
FIG. 6 is a schematic side elevational view of the gun with the adapter, accessory and a support for the adapter.
Figure 7:
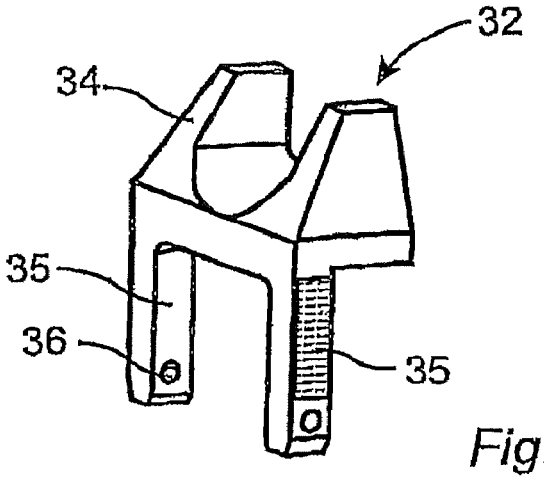
FIG. 7 is a perspective view of the support in FIG. 6.

In the embodiment shown in FIG. 6 the adapter 10 is provided also with a support 32 (cf. also FIG. 7). The support 32 is used to protect the trigger guard of the gun, which can be exposed to a substantial load if the lamp or adapter 10 is exposed to lateral forces. In the embodiment shown the support is snapped into a groove 33 in a front section of the adapter 10.

FIG. 7 more clearly shows the support 32 and it is obvious that the support comprises a U-formed upper part 34 and two from the upper part 34 in parallel and spaced apart extending supporting arms 35. The U-formed upper part 34 is adapted to a lower part of the gun below the barrel and will clutch this part of the gun when the adapter is turned in position. The supporting arms 35 are pushed into the grooves 33 of the adapter 10 (cf. FIG. 6) and are locked by snapping projections 36 on the inside of the supporting arms in corresponding holes (not shown) in the grooves of the adapter 10.

Figure 8:
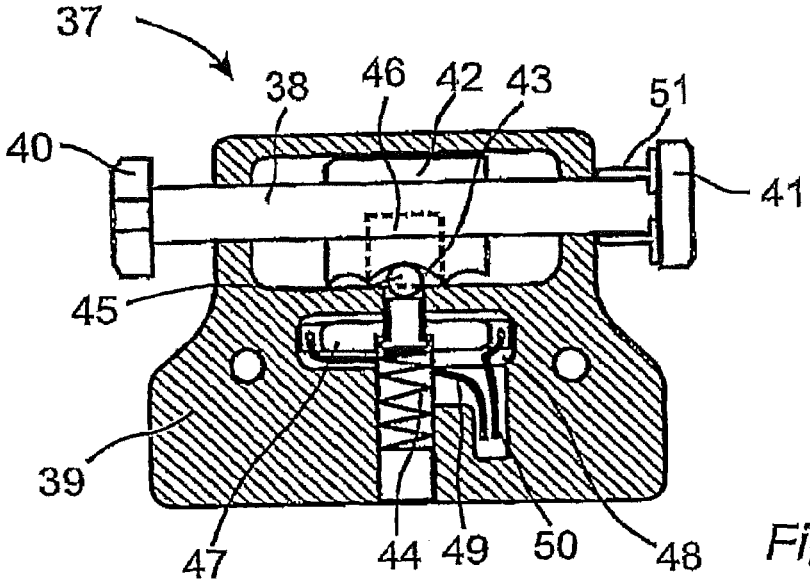
FIG. 8 is a schematic side elevational view of a switch comprised in the adapter in FIG. 5 in a resting position and FIG. 9 is a schematic side elevational view of the switch in FIG. 8 in an end position.

FIG. 8 shows one embodiment of a switch 37 that can be used for switching on and switching off the accessory that is connected to the adapter. The switch 37 comprises operating means 30 in the form of an elongated shaft 38 extending through an upper section of a case 39. The shaft 38 is connected in a first end to a on button 40 and to a second end to an off button 41. The on button can readily switch place with the off button 41, so as to better fit left handed users.

The shaft 38 supports centrally a curved piece 42 having three connected curved sections. Two outer curved sections of the same depth connects to an intermediate central curved section 43 having a somewhat larger depth than the outer sections. Two pointed tips separate the curved sections from each other. Centrally in the case 39 and below the shaft 38 there is provided a ball 45 biased by a spring 44. The ball 45 can run in the curved sections and as a result of the spring force a larger resistance has to be overcome to move the curved piece 42 past the pointed tips.

The shaft 38 also supports centrally a permanent magnet 46, which will be moved together with the curved piece 42. Centrally in the case 39 there is provided a magnetically actuated means in the form of a reed 47 that is arranged in a hollow space 48. The reed 47 will brake a circuit between an input conductor 49 and an output conductor 50 at some influence of a magnetic field. The input conductor 49 and the output conductor 50 are parts of an electric circuit that also comprises a power source (for instance a battery, not shown) and an electrically powered accessory (for instance a lamp 27).

When the curved piece 42 is in a central position as shown in FIG. 8 with the ball 45 pressed into the central curved section 43 the permanent magnet 46 will actuate on the reed 42 to open the electrical circuit. Thus, in this position a lamp included in the electric circuit is turned off and this position forms a first resting position. The pressure of the spring 44 will press the ball 45 up in to the bottom of the central curved section 43 and will ensure that the shaft 38 and the permanent magnet 46 do not move without an active control.

By supplying a force and moving the shaft 38 to the right or to the left in FIG. 8 against the resistance produced by the movement of the ball 45 in the central curved section 43 the shaft 38 and the permanent magnet 46 will be displaced. As a result the reed 47 will be affected by a changed magnetic field from the permanent magnet 46 to such an extent that the open position is left. As a result the tongues of the reed 47 will be affected by magnetic fields of different strengths which means that they will be closed to form electric contact and to close the electric circuit and make the lamp glow. If the movement of the shaft 38 is limited and the ball 45 never leaves the central curved section 43 the shaft will spring back, when the applied force stops to exist The result will be a flashing function.

Figure 9:
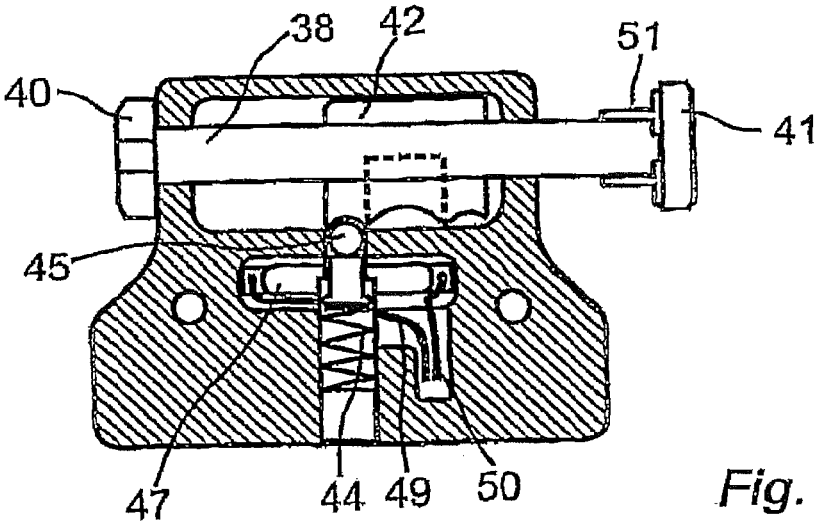

In the embodiment shown in FIG. 8 and FIG. 9 the shaft 38 on one side is provided with a sleeve 51 on the inside of the off button 41. The sleeve will prevent a movement of the shaft 38 to the left in the figures to a turned on position, because the sleeve engages the case 39 and thus will not allow a further movement to the left. Thus, the sleeve will ensure that the user who has not turned on the light by mistake will not move the shaft 38 past the central position in which the lamp is turned off to a second turned on position. The sleeve can be moved to the opposite side of the shaft resulting in a reverse function with relation to the direction in which the shaft is moved for turning on and turning off, respectively.

In the position shown in FIG. 9 the shaft 38 has been moved by a force on the on button 40 so far to the right that the ball has passed the tip separating the central curved section 43 from the second curved section beside said central section and instead has entered this second curved section. In this position the permanent magnet will affect the reed 47 to make it close the electrical circuit. By pressing the ball into the curved section the shaft will remain in this second resting position until a force acts on the off button 41 to the left in FIG. 9. As described above the movement to the left will end when the shaft 51 engages the case 39.

As an alternative to the shown embodiment the reed can be connected to the shaft 38, thus being moveable in relation to the permanent magnet. The relative movement between the magnetically controlled means and the magnet that is required to close and open the electrical circuit with a lamp or another accessory can be provided by the moving shaft also in this embodiment.

The invention claimed is:

1. A gun accessory mounting device, characterized in that the accessory is connected to an adapter, that said adapter is provided with a gripping means, and that said gripping means comprises a spring biased clamping mechanism and a counter stay cooperating with said clamping mechanism, wherein a distance between a pressure plate and a lever of the spring biased clamping mechanism is reduced when the accessory is pivoted from a first position to a second position; and wherein said counter stay comprises a shackle handle adapted to a trigger guard of the gun.

2. Mounting device, characterized in accordance with claim 1, wherein said adapter is provided with retaining means for the accessory, said retaining means being pivotably connected to said clamping mechanism for clamping said clamping mechanism when said accessory is pivoted.

3. Mounting device in accordance with claim 1, wherein said clamping mechanism comprises the lever, a rod connected to said lever, a pivoted clamping arm connected to said rod and the pressure plate spring biased against said lever, and wherein said rod is biasing said pressure plate when the clamping arm is rotated.

4. Mounting device in accordance with claim 3, wherein a spring is provided between the lever and the pressure plate for biasing said pressure plate when the clamping arm is stretched.

5. Mounting device in accordance with claim 3, wherein said rod is movable between a first released position and a second locked position in which the rod is locked by a spring biasing effect.

6. Mounting device in accordance with claim 3, wherein a manually controlled locking device is provided on said adapter and said rod is movable between a first released position and a second locked position in which the rod is locked by the locking device.

7. An accessory for mounting on a gun, characterized in that the accessory comprises a lamp rigidly connected to an adapter, that the adapter is provided with gripping means, that said gripping means comprises a spring biased clamping mechanism and a counter stay cooperating with said clamping mechanism, wherein a distance between a pressure plate and a lever of the spring biased clamping mechanism is reduced when the accessory is rotated from a first position to a second position, and that said adapter is provided with a switch for turning said lamp on and off.

8. An accessory in accordance with claim 7, wherein said clamping mechanism comprises the lever, a rod connected to said lever, a pivoted clamping arm connected to said rod and the pressure plate spring biased against said lever, and wherein said rod presents a load on the pressure plate when the clamping arm is rotated.

9. An accessory in accordance with claim 8, wherein a manually controlled locking device is provided on said adapter, and said rod being movable between a first released position and a second locked position in which the rod is locked by the locking device.

10. An accessory in accordance with claim 7, wherein said switch comprises a magnetically controlled switching element and a magnet that can be moved in relation to the switching element.

11. An accessory in accordance with claim 10, wherein said magnet is rigidly connected to a sliding and spring bias shaft.

12. An accessory in accordance with claim 11, wherein said spring bias shaft is displaceable between a first resting position, in which said switching element opens a circuit, and a second resting position, in which said switching element closes a circuit.

13. An accessory in accordance with claim 12, wherein said spring biased shaft is resiliently displaceable between said first resting position and an instable position in which said switching element closes a circuit.

* * * * *